United States Patent [19]

McConnell

[11] Patent Number: 4,726,730

[45] Date of Patent: Feb. 23, 1988

[54] DEVICE FOR HANDLING A WHEELCHAIR

[76] Inventor: Sylvia J. McConnell, P.O. Box 4048, Opelika, Ala. 36801

[21] Appl. No.: 869,983

[22] Filed: Jun. 3, 1986

[51] Int. Cl.[4] ..... A61G 7/10

[52] U.S. Cl. ..... 414/678; 254/122; 414/921

[58] Field of Search ..... 297/DIG. 4; 269/323; 410/51; 414/495, 678, 778, 754, 921; 254/122, 126

[56] References Cited

U.S. PATENT DOCUMENTS

| | | | |
|---|---|---|---|
| 3,116,910 | 1/1964 | Moore et al. | 254/126 |
| 3,363,778 | 1/1968 | Larsson | 414/678 |
| 3,451,655 | 6/1969 | Scott | 254/126 X |
| 3,476,404 | 11/1969 | Rachman | 297/DIG. 4 X |
| 3,888,463 | 6/1975 | O'Brien et al. | 414/921 X |
| 4,192,549 | 3/1980 | Petersen | 414/678 X |
| 4,492,403 | 1/1985 | Blomgren et al. | 410/51 X |
| 4,504,988 | 3/1985 | Deutchman | 414/921 X |

FOREIGN PATENT DOCUMENTS

| | | | |
|---|---|---|---|
| 3325036 | 1/1985 | Fed. Rep. of Germany | 414/921 |
| 52-9260 | 1/1977 | Japan | 254/126 |

*Primary Examiner*—Frank E. Werner
*Assistant Examiner*—Janice Krizek
*Attorney, Agent, or Firm*—George J. Porter

[57] ABSTRACT

A device (10) for selectively lifting and tilting a wheelchair (14) and its occupant to a convenient position for convenient performance of a service such as dental work upon the occupant of the wheelchair wherein there is a base (16), a platform (24), a support frame (64) attached between said base and platform, a reversible motor (40) and jack mechanism (42 and 56) attached between the base (16) and support frame (64) for lifting or lowering the support frame (64), a reversible motor (82) and actuator mechanism (84) attached between the support frame (64) and the platform (24) for tilting the platform (24) in a desired direction, safety belts (28) for securing the wheelchair and its occupant to the platform, two sets of switches (32 and 34) for selected actuation of the device (10), one (32) of which may be operated by hand and the other (34) being foot-controlled.

11 Claims, 5 Drawing Figures

DEVICE FOR HANDLING A WHEELCHAIR

TECHNICAL FIELD

The present invention relates to a device for handling a wheelchair and its occupant and more particularly to a device which is capable of securely holding the wheelchair while lifting and tilting it to a convenient position for performance of a service to the occupant. For example, the device is particularly suitable for positioning a wheelchair occupant for convenient rendering of services such as those performed in a dental office or a beauty salon.

BACKGROUND OF THE INVENTION

It has long been a serious problem to conveniently position those confined to wheelchairs for receiving services to their person such as would be performed by a beauty operator, a dentist, or other services which may require the occupant of the wheelchair to be raised, lowered, or tilted in order to effectively perform the intended service. Prior to the advent of wheelchair handling devices, it was necessary to move the occupant of the wheelchair physically by lifting the person to a special positioning chair in order to receive services such as a hair shampoo or dental work. In many cases movement of persons confined to wheelchairs can be quite dangerous in that the injury or impairment which causes confinement to the wheelchair may be seriously aggravated.

As mentioned in my earlier copending patent application (U.S. Pat. No. 4,592,695 dated June 3, 1986) several prior art patents are of interest because they relate to the above-mentioned problems. Of these, U.S. Pat. No. 4,227,740 to EAST shows a simple attachment for a wheelchair which allows a wheelchair to be tilted backward so that the occupant can rest or sleep. However, this structure is somewhat light and flimsy and does not instill confidence in the occupant of the wheelchair. Moreover, this device does not have sufficient versatility to accomplish the objects of this invention since it cannot be raised and it may be tilted backward to only one angle, which is about 55 degrees from the vertical. This is not sufficient for the purpose of performing the necessary services to the wheelchair occupant. For maximum convenience in performance of such services the occupant must really be tilted backward about 80 degrees or more. It is also apparent that the device of EAST does not substantially support the wheelchair in the forward direction. Obviously, if one were to lean forward in such a chair, it would tilt forward very quickly, resulting in possible injury to the occupant. It is also readily apparent that this device does not provide the feature which enables lifting the wheelchair to a height which is convenient for performance of the services needed. It is further obvious that this device requires modification to the wheelchair and that it is not intended for universal use with a standard wheelchair.

A second prior art patent of interest is U.S. Pat. No. 4,158,524 to SERAFIN. This patent shows a platform for raising a wheelchair from ground level to a higher level, such as a porch. This patent does not contemplate and does not show any structure for securely holding the wheelchair on the platform and tilting the platform through an angle of 45 degrees to 90 degrees as does the present invention.

U.S. Pat. No. 4,024,960 to FORSTER shows a large tilting platform for raising one end of a truck or car.

However, this platform is considerably larger than would be necessary to hold a wheelchair. Moreover, this patented invention does not contemplate securing anything to the platform while it is being raised and of course does not provide any structure for securing or tilting a wheelchair.

None of the known prior art patents mentioned above contemplate raising and tilting a wheelchair on a platform and securing the wheelchair securely to the platform in order to tilt it through an angle of 45 degrees to 90 degrees for purposes of performing a service to the occupant of a wheelchair.

Therefore, it is an object of this invention to provide a lifting and tilting platform with a means attached to the platform for securely holding a wheelchair on the platform, for performing a service to the occupant of a wheelchair without the occupant having to leave his/her wheelchair.

It is another object of this invention to provide a wheelchair handling device which can lift a wheelchair and tilt it backwards through an angle of 45 degrees to 90 degrees, for performing a service to the occupant of a wheelchair.

It is a further object of this invention to provide a lifting and tilting platform for a wheelchair, the platform having a motor-driven mechanism to operate the device.

It is yet another object of this invention to provide a lifting and tilting platform for a wheelchair, the platform being arranged to be simply and quickly operated by the use of convenient hand or foot controls.

It is a still further object of this invention to provide a safe and efficient wheelchair handling device, requiring only one operator, for securely holding a wheelchair and lifting and tilting the wheelchair backwards in order to perform a service to the occupant of a wheelchair.

SUMMARY OF THE INVENTION

The present invention is a lifting and tilting device for persons confined to a wheelchair. It is capable of securely holding a wheelchair on its platform and of lifting and tilting the wheelchair and its occupant. Thus the device functions to position the occupant for convenient access by a person performing a service such as a shampoo or dental work on the occupant of the wheelchair. The invention comprises a base; a platform; a support frame attached between said base and platform; means attached between said base and said support frame for lifting said support frame; means attached between said support frame and said platform for tilting said platform: and means for securing a wheelchair and its occupant on said platform.

DETAILED DESCRIPTION OF THE INVENTION

The present invention is a lifting and tilting device for handling a wheelchair and its occupant so as to position the occupant for receiving a service such as a hair shampoo or dental work.

Figure 1:
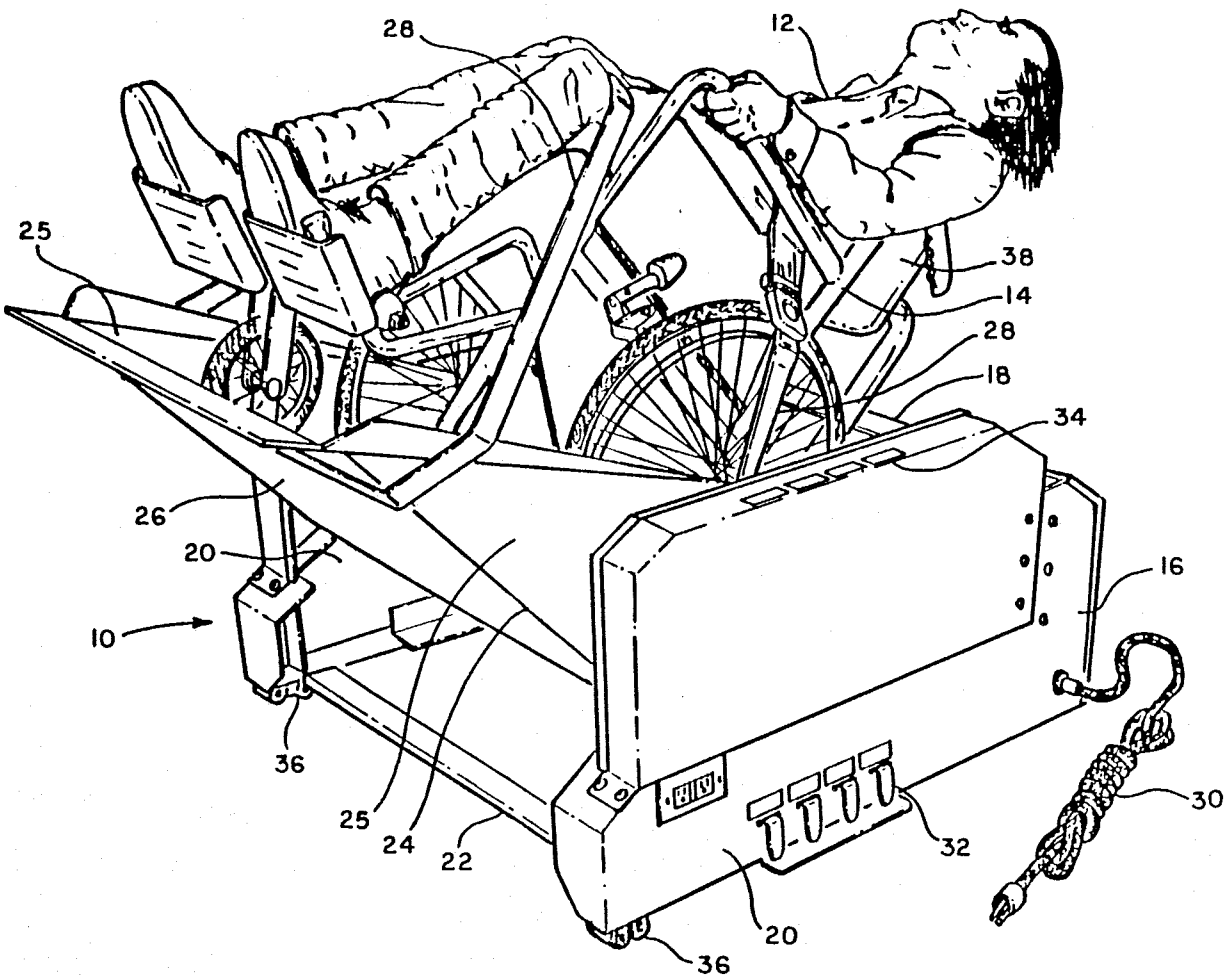
FIG. 1 is a perspective view of the wheelchair handling device with a person in a wheelchair after having been lifted and tilted.

Looking now at FIG. 1 the device is shown generally by numeral 10. As shown, a person 12 is sitting in a wheelchair 14 in a raised and tilted position such as would be convenient for receiving a service such as a hair shampoo or dental work. The device comprises a generally U-shaped base 16 having a rear closed portion 18, legs 20, and a cross plate 22 which provides support for the generally open forward end of the base. Mounted in the open portion of the base 16 is a platform 24 which comprises side members 25 connected at their lower edges by a floor 26. The wheelchair 14 and its occupant 12 are held firmly in place by safety belts 28 which pass along the platform sides 26 and over the wheelchair and its occupant.

The platform 24 is actuated by reversible electric motors through lift and tilt actuators all of which will be described in greater detail later in this description. Power is supplied to the motors through cord 30. Two sets of four switches 32 and 34 provide the means for supplying power to the electric motors for selectively raising, lowering, or tilting the platform 24. As will be noted the upper set of switches is adapted for hand operation while the lower set is adapted for foot actuation. The device is made portable by inclusion of rollers 36.

Figure 2:
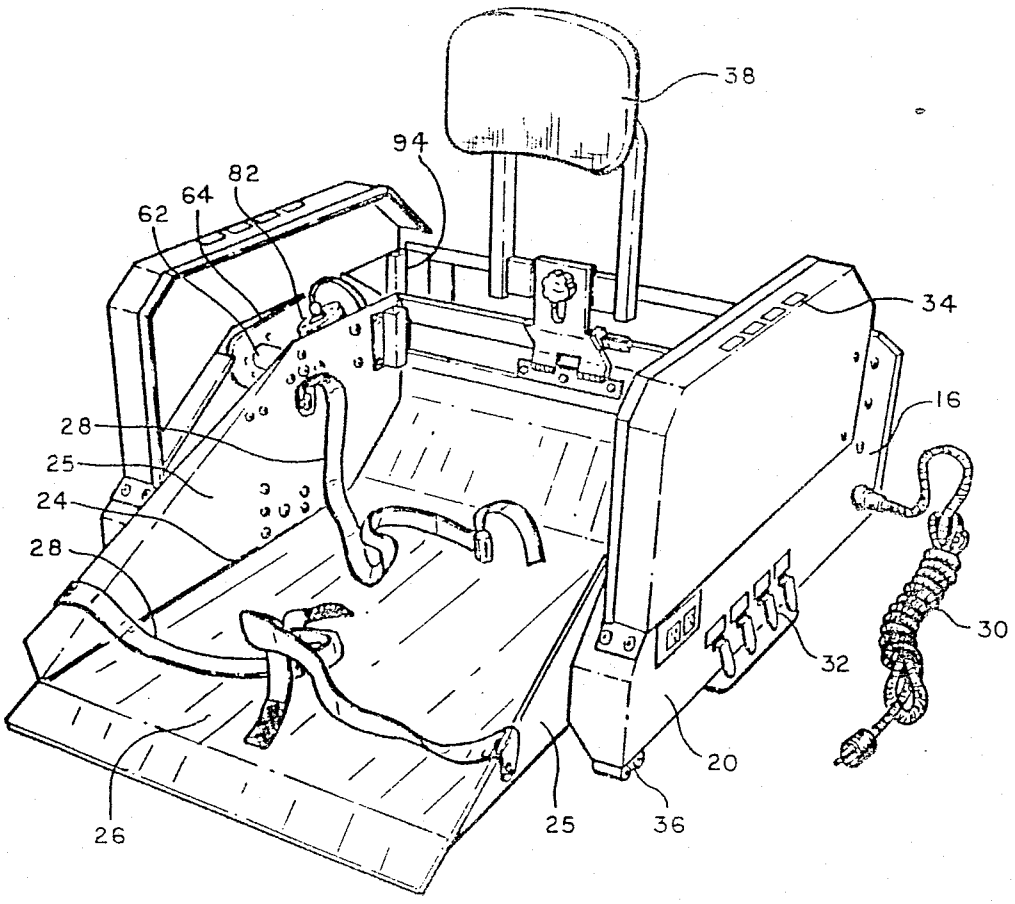
FIG. 2 is a perspective view of the wheelchair handling device in its lowered position.

As best illustrated in FIG. 2 the rear portion of platform 24 is provided with an adjustable backrest 38 which serves to support the wheelchair and its occupant when in the lifted and tilted position illustrated in FIG. 1. As is also illustrated in FIG. 2 the rear portion of the platform floor 26 is curved upwardly so as to support the wheels of the wheelchair 14 when the platform is in the raised and tilted position as illustrated in FIG. 1.

Figure 3:
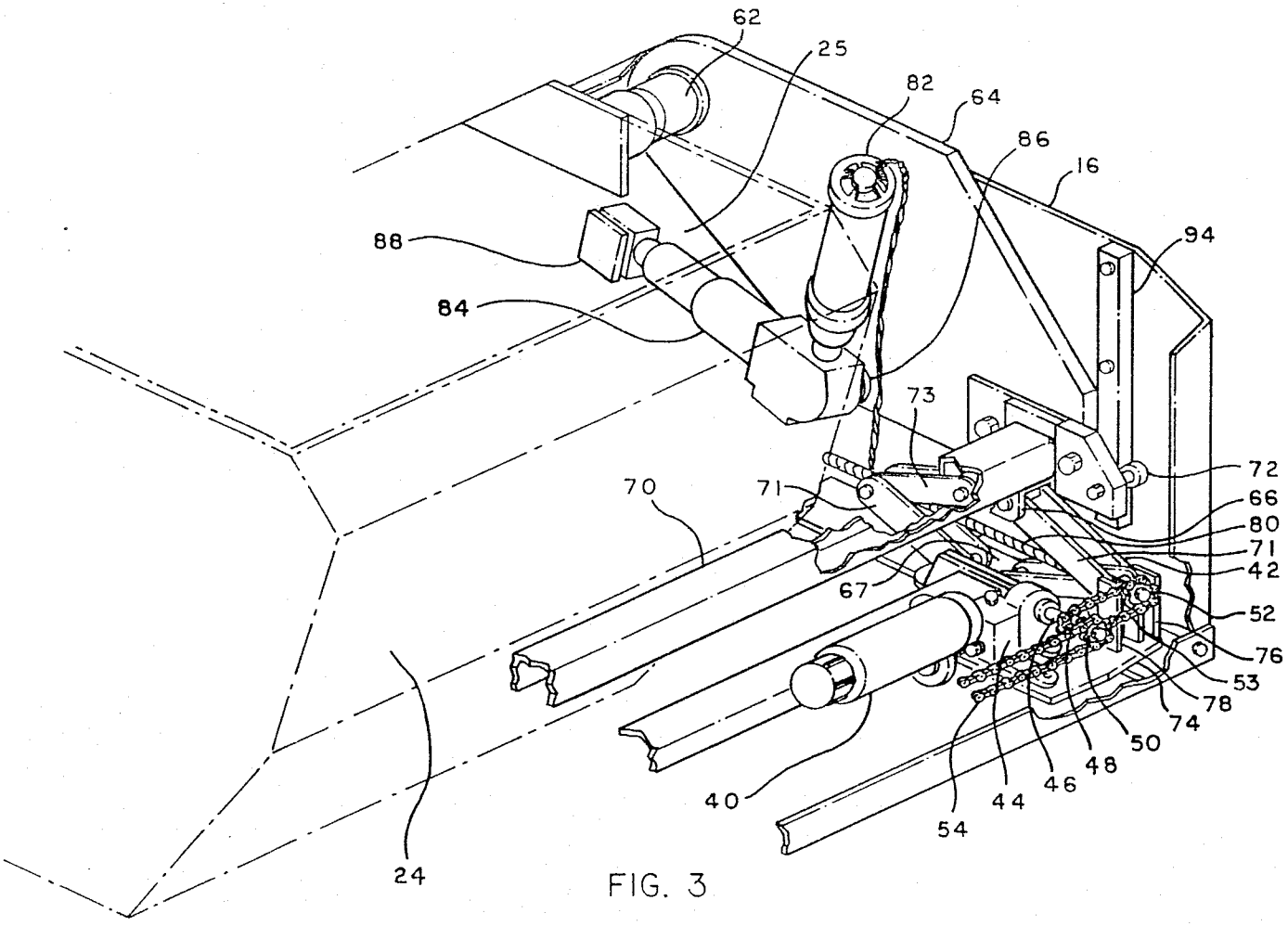
FIG. 3 is a fragmentary perspective view of the wheelchair handling device with portions broken away to more clearly illustrate the lifting and tilting mechanisms.
Figure 4:
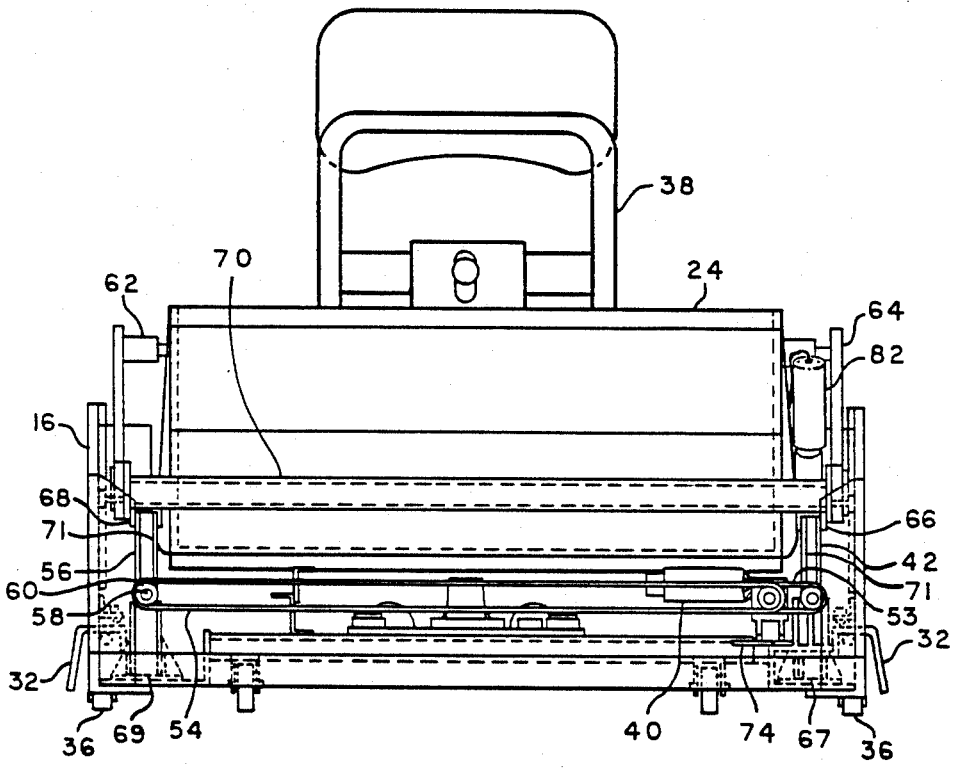
FIG. 4 is a rear view of the wheelchair handling device with portions thereof cut away to illustrate the operating mechanism of the device.
Figure 5:
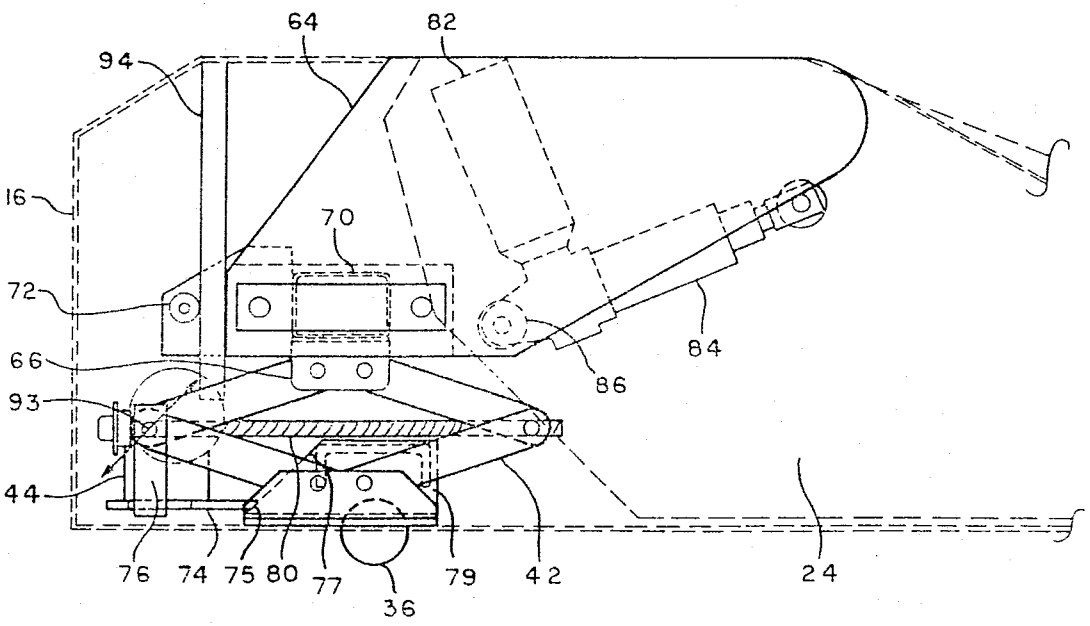
FIG. 5 is a fragmentary elevational view of the invention with portions broken away to more clearly illustrate the inner workings of the device.

The actuator mechanisms for lifting and tilting the platform 24 are best illustrated in FIGS. 3, 4, and 5 wherein portions of the device are shown in phantom and portions are broken away for clarity.

Referring now to FIGS. 3 and 4, a reversible motor 40 is utilized to operate a pair of scissors type lifting jacks 42 and 56 by transmitting driving power via transmission 44, shaft 46, sprockets 48, 50, 52, and 60, and chains 53 and 54. As best illustrated in FIG. 4, chain 54 transmits driving power to jack 56 through a sprocket 60 and a shaft 58. Thus it will be seen that the jacks 42 and 56 are actuated either up or down in unison by reversible motor 40.

As best illustrated in FIG. 3 the platform 24 is attached by a pivot connection 62 to a support frame 64 which in turn is attached to upper jack plates 66 and 68 of jacks 42 and 56 by support 70. The upper jack plates are connected to lower jack plates 67 and 69 by pairs of rearward and forward actuator arms 71 and 73. The support frame 64 is stabilized as it moves up and down by roller 72 and a slide (not shown), one on either side of a vertical bar 94. Thus it is seen that as the jacks 42 and 56 are actuated the support frame 64 and platform 24 may be raised or lowered in a generally vertical direction. As best illustrated in FIGS. 3 and 5 motor 40 and transmission 44 are mounted on a plate 74 which in turn is attached to pivot pin 93 on the aft end of jack 42 by means of vertical supports 76 and 78 and is thus free to move in a vertical direction as the screw shaft 80 is rotated and also moves in a vertical direction.

As best illustrated in FIG. 5 the forward edge 75 of mounting plate 74 is tapered to slideably interface with the tapered rear surface 77 of a vertical guide bar 79. Thus it will be seen that as the jacks are operated, for example, in an upward direction from the position illustrated in FIG. 5, the forward edge 75 of mounting plate 74 will follow the tapered rear surface 77 of guide bar 79 in an upward and forward direction. The angle of the surface 77 is a duplicate of the angle at which the pivot pin 73 moves in an upward and forward direction, as illustrated by the arrow extending in that direction from pin 73. Thus as the jack is operated the mounting plate 74 is constantly maintained in a position parallel to shaft 80. This relationship is necessary to maintain alignment of the driving chains and sprockets as the motor 40 and transmission 44 follow the movement of jack pin 73 when the jacks are actuated.

As illustrated in FIGS. 3 and 5 platform 24 is pivotally attached to support 64 by pivot connection 62. The tilting of platform 24 about pivot connection 62 is accomplished by operation of a reversible motor 82 which in turn lengthens and shortens a conventional actuator 84 which is connected to support frame 64 at its base end 86 and at its distal end 88 to side member 25 of platform 24.

To operate the wheel chair handling device 10 and referring now to FIGS. 1, 3, and 4, after having securely placed the wheel chair 14 and its occupant 12 on the platform 24, an operator of the device would lift the platform to a desired height by operation of the appropriately labeled switch from either switch set 32 or 34. Operation of the appropriate lift switch would actuate motor 40 which through its drive mechanism will cause the jacks 42 and 56 to raise the support frame 64 and platform 24. Either during the lifting operation, or after, the platform may be tilted by operating the appropriately labeled tilt switch in either switch set 32 or 34. Operation of either a forward or rearward tilt switch will start motor 82 which causes actuator 84 to lengthen or shorten as desired thus tilting platform 24, the wheelchair, and its occupant to the desired position.

I claim:

1. A wheelchair handling device comprising:

a stationary base, said base being generally U-shaped;

a support frame;

a platform, said platform being rotatably attached to said support frame, said platform being positioned within an open end of said U-shaped base, said platform having a generally vertically curved closed end and tapering generally to a low open end, whereby said platform is adapted to receive a rolling wheelchair at its open end and retain said wheelchair in its closed end;

lifting means moveably attaching said support frame to said base for selectively raising or lowering said support frame vertically with respect to said base, said lifting means comprising:

a pair of jacks connected between said base and said support frame;

a reversible motor driving both said jacks;

means connecting said motor to said jacks, said connecting means comprising:

a transmission connected to said motor;
a sprocket shaft connected to said transmission;
two first sprocket wheels connected to said sprocket shaft;
two drive chains, said drive chains being connected to and driven by respective first sprocket wheels;
two jack-driving screw shafts, said screw shafts being connected to respective jacks;
two second sprocket wheels, said second sprocket wheels being connected to respective jack-driving shafts;
whereby said drive chains rotate respective second sprocket wheels in either direction to either raise or lower said jacks in unison and thereby either raise or lower said support frame.

2. The wheelchair handling device of claim 1 wherein fastening means are attached to said platform for rigidly attaching a wheelchair to said platform.

3. A wheelchair handling device comprising:
a stationary U-shaped base, said base comprising:
two vertical sides;
a back connecting said two vertical sides, said back comprising an attached vertically-adjustable back rest;
a scoop-shaped platform attached to said base, said platform comprising:
a rectangular floor;
two side panels connected to the sides of said floor, said side panels each having a five-sided configuration, including a forward side, and an attached flange which extends outward from said forward side;
a sloping back panel, said back panel having a forward, lower edge and a rearward, higher edge, said forward, lower edge being connected to the back edge of said floor;
a vertical back panel, said vertical back panel being connected to said rearward, higher edge of said sloping back panel; and
a sloping ramp attached to the front edge of said rectangular floor;
a support frame, said frame having two sides and being moveably attached to said base and rotatably attaching said platform thereto, said support frame being adapted to be lifted in a generally vertical direction; and
lifting means attaching said support frame to said base, said lifting means comprising:
a pair of jacks, each said jack connected between one said side of said base and one said side of said support frame;
a first reversible motor driving both said jacks, for raising and lowering said jacks; and
means connecting said motor to said jacks, said connecting means comprising:
a transmission connected to said motor;
a sprocket shaft connected to said transmission;
two first sprocket wheels connected to said sprocket shaft;
two drive chains, said drive chains being connected to and driven by respective first sprocket wheels;
two jack-driving screw shafts, said jack-driving screw shafts being connected to respective jacks;
two second sprocket wheels, said second sprocket wheels being connected to respective jack driving shafts;
whereby said drive chains rotate respective of said second sprocket wheels in either direction to either raise or lower said jacks in unison and thereby either raise or lower said support frame.

4. The wheelchair handling device of claim 3 wherein said support frame is connected to said platform by a tilting means and a platform pivot means whereby operation of said tilting means will tilt said platform with respect to said support frame about said platform pivot means.

5. The wheelchair handling device of claim 4 wherein said tilting means comprises:
a second reversible motor; and
an elongated actuator connected to said motor, said actuator having a base end and a distal end, said base end of said actuator being pivotally connected to said support frame and said distal end being pivotally connected to said platform, said actuator being arranged and configured so that it is capable of either shortening or lengthening itself in response to said motor.

6. The wheelchair handling device of claim 5 comprising four hand-operated switches mounted at the top of one of said vertical sides of said base, two of said switches being connected to said first reversible motor to raise or lower said support frame and the other two said switches being connected to said second reversible motor to tilt said platform about said platform pivot means.

7. The wheelchair handling device of claim 6 comprising four foot-operated switches, mounted at the bottom of said one of said vertical sides of said base, below said hand switches, each said foot-operated switch being connected in parallel with a corresponding one of said hand switches, whereby said support frame may be raised or lowered and said platform may be tilted forward or backward by either said hand switches or said foot switches.

8. The wheelchair handling device of claim 3 comprising a mounting means for attaching said first reversible motor to one of said jacks whereby said first reversible motor is raised and lowered as said support frame is raised and lowered.

9. The wheelchair handling device of claim 8 wherein said mounting means comprises:
a mounting plate having a forward edge, said first reversible motor and said transmission being attached to said plate; and
a pivot pin attached to an aft end of said one of said jacks, said pivot pin also being attached to said mounting plate;
whereby said mounting plate is free to move in a vertical direction as said jack-driving screw shafts are rotated and as said shafts move in a vertical direction.

10. The wheelchair handling device of claim 9 comprising an alignment means for maintaining said first reversible motor in alignment with said one of said jacks as said first reversible motor is raised and lowered, said alignment means comprising a vertical guide bar having a tapered rear edge and attached to said base and wherein said forward edge of said mounting plate is tapered to slideably interface with said tapered rear edge of said vertical guide bar.

11. The wheelchair handling device of claim 3 comprising means for stabilizing said support frame as said support frame moves up and down, said stabilizing means comprising:

a vertical stabilizing bar attached to one of said vertical sides of said base, said bar having a flat front edge and a flat rear edge;

a roller attached to the top of one of said jacks and positioned so that it will make rolling contact with said flat rear edge of said stabilizing bar as said jack moves up and down; and wherein said support frame has a flat rear edge which slideably interfaces with said flat front edge of said stabilizing bar.

* * * * *